US011108190B2

(12) United States Patent
Zhu et al.

(10) Patent No.: US 11,108,190 B2
(45) Date of Patent: Aug. 31, 2021

(54) ELECTRICAL CONNECTOR MATING PORT ENCLOSED BY INNER SLEEVE AND OUTER COVER

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventors: Zheng-Rong Zhu, Kunshan (CN); Jun Chen, Kunshan (CN); Jerry Wu, Irvine, CA (US)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/800,605

(22) Filed: Feb. 25, 2020

(65) Prior Publication Data

US 2020/0274287 A1 Aug. 27, 2020

(30) Foreign Application Priority Data

Feb. 25, 2019 (CN) ..... 201910136990.4

(51) Int. Cl.
*H01R 13/504* (2006.01)
*H01R 13/52* (2006.01)
*H01R 13/627* (2006.01)
*H01R 13/6582* (2011.01)

(52) U.S. Cl.
CPC ..... *H01R 13/5213* (2013.01); *H01R 13/504* (2013.01); *H01R 13/6273* (2013.01); *H01R 13/6582* (2013.01)

(58) Field of Classification Search
CPC ..... H01R 13/5213; H01R 13/6273; H01R 13/6582; H01R 13/502; H01R 13/504; H01R 13/5845; H01R 13/5025
See application file for complete search history.

(56) References Cited

U.S. PATENT DOCUMENTS

| | | | | |
|---|---|---|---|---|
| 5,197,895 A * | 3/1993 | Stupecky | ..... | A61B 5/087 285/119 |
| 6,338,657 B1 * | 1/2002 | Harper | ..... | A61B 18/14 439/598 |
| 8,562,378 B2 | 10/2013 | Su et al. | | |
| 9,472,911 B2 * | 10/2016 | Little | ..... | H01R 24/00 |
| 9,831,610 B2 | 11/2017 | Sutter et al. | | |

* cited by examiner

*Primary Examiner* — Vanessa Girardi
(74) *Attorney, Agent, or Firm* — Ming Chieh Chang; Wei Te Chung

(57) ABSTRACT

An electrical connector includes: a connector unit having a mating part, the mating part defining a front mating end; a sleeve enclosing the mating part and extending forwardly beyond the front mating end to define a receiving chamber; and an outer cover enclosing the sleeve and the connector unit, wherein the sleeve has a front portion containing the receiving chamber, and the outer cover is made of a material softer than the sleeve.

20 Claims, 26 Drawing Sheets

ELECTRICAL CONNECTOR MATING PORT ENCLOSED BY INNER SLEEVE AND OUTER COVER

BACKGROUND OF THE INVENTION

1. Field of the Invention

The present invention relates to an electrical connector comprising: a connector unit having a mating part, the mating part defining a front mating end; a sleeve enclosing the mating part and extending forwardly beyond the front mating end to define a receiving chamber; and an outer cover enclosing the sleeve and the connector unit, wherein the sleeve is designed to provide desired structural strength while the outer cover is designed to be versatile in color, material, and finish.

2. Description of Related Art

U.S. Pat. No. 9,831,610 discloses a cable connector comprising: a connector unit having a mating part, the mating part defining a front mating end; and an insulative connector housing that is formed from two inter engaging halves that cooperatively define a hollow interior that houses a connector body of the connector unit therein.

SUMMARY OF THE INVENTION

An electrical connector comprises: a connector unit having a mating part, the mating part defining a front mating end; a sleeve enclosing the mating part and extending forwardly beyond the front mating end to define a receiving chamber; and an outer cover enclosing the sleeve and the connector unit, wherein the sleeve has a front portion containing the receiving chamber, and the outer cover is made of a material softer than the sleeve.

DETAILED DESCRIPTION OF THE PREFERRED EMBODIMENT

Figure 1:
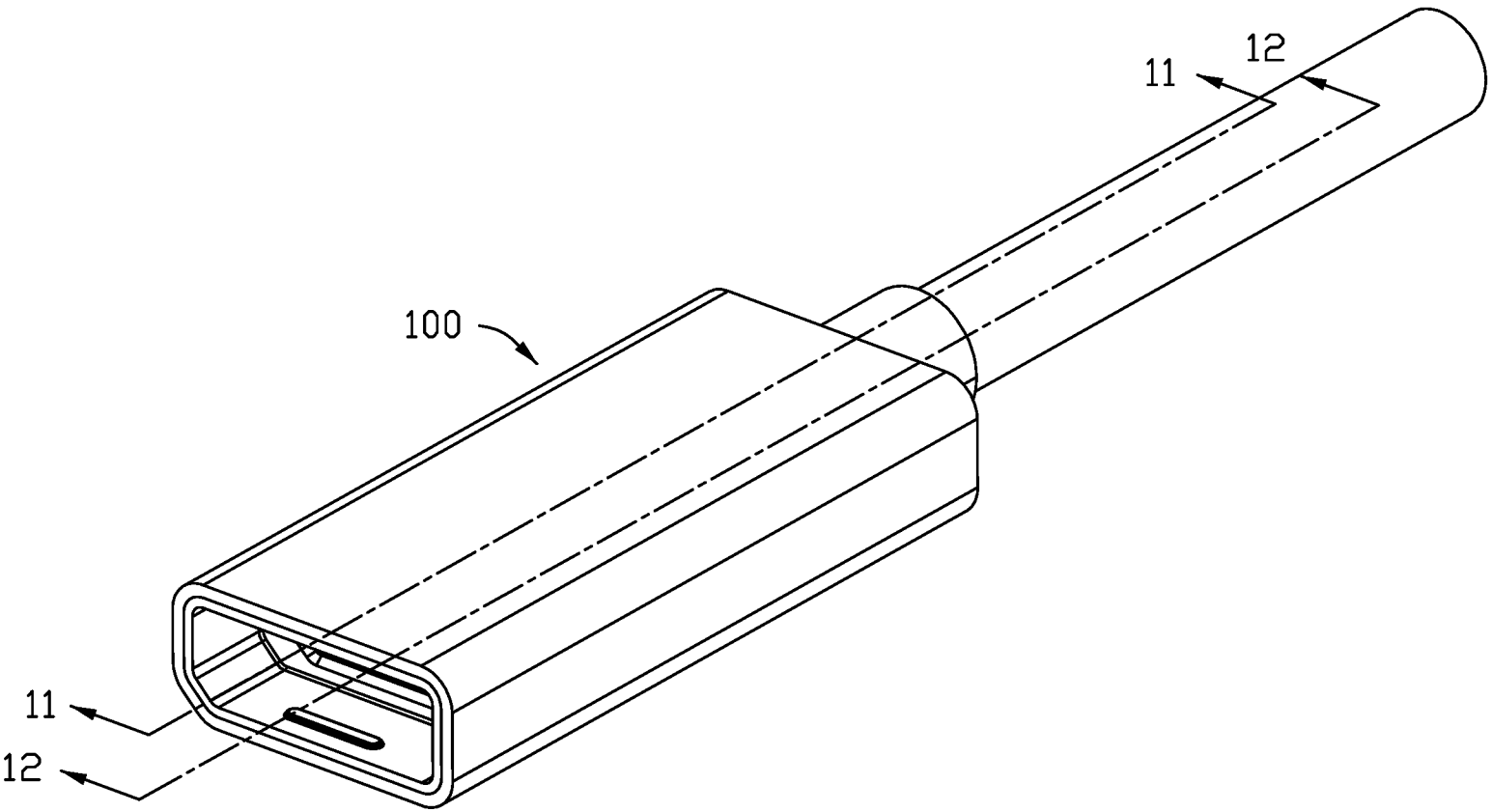
FIG. 1 is a perspective view of an electrical connector in accordance with a first embodiment of the present invention.
Figure 2:
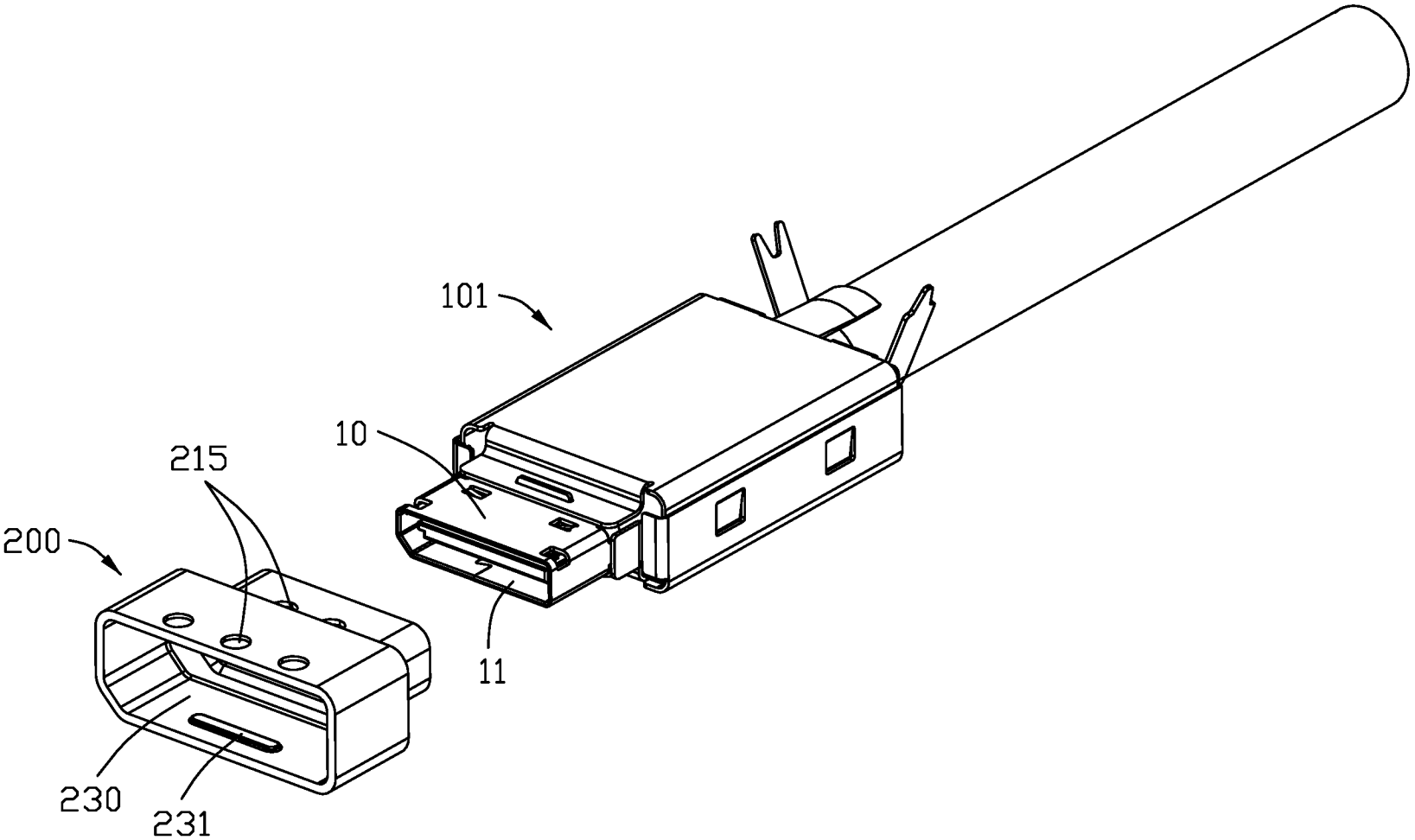
FIG. 2 is an exploded view of the electrical connector omitting an outer cover thereof.
Figure 3:
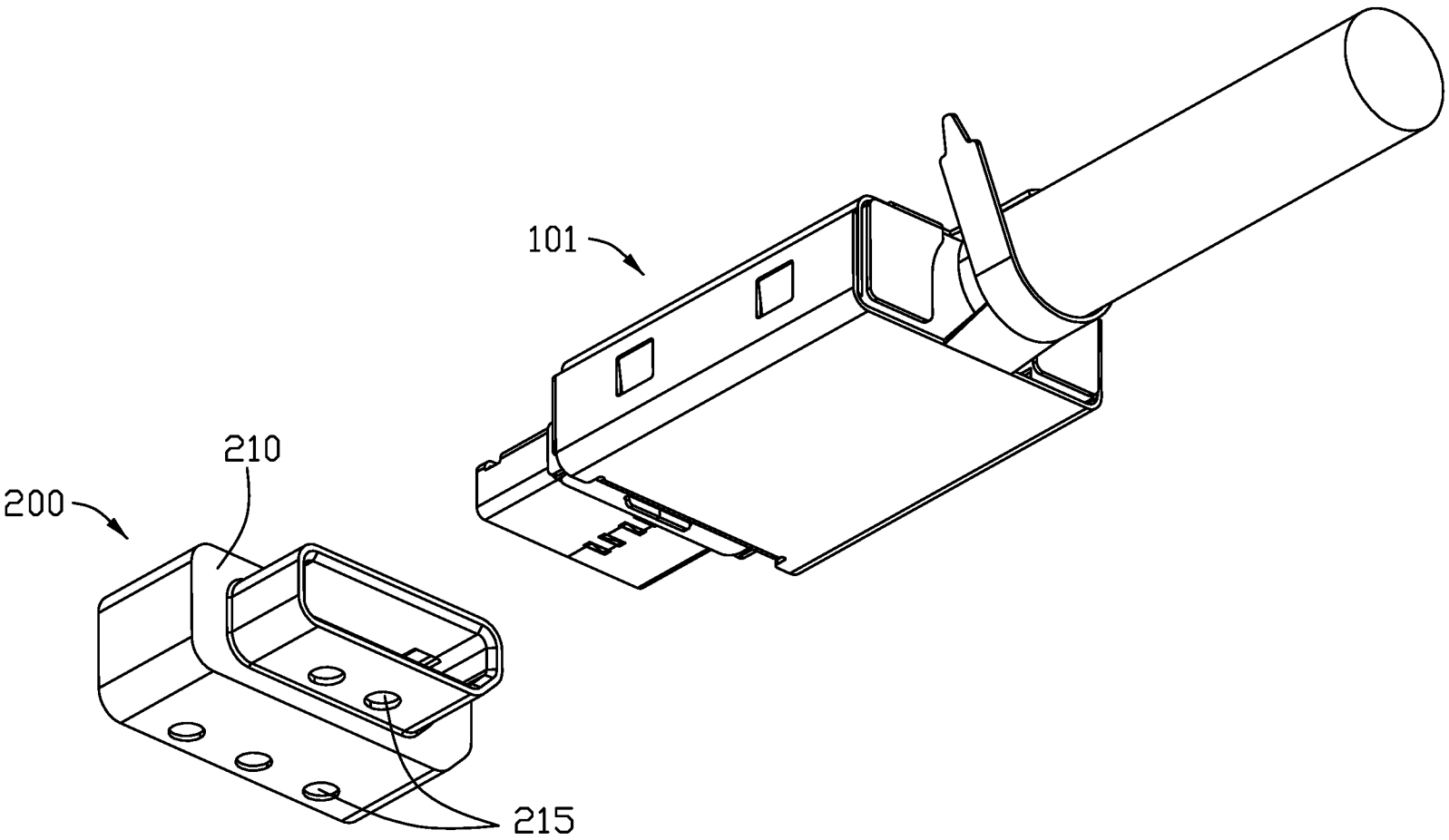
FIG. 3 is a view similar to FIG. 2 but from a different perspective.
Figure 4:
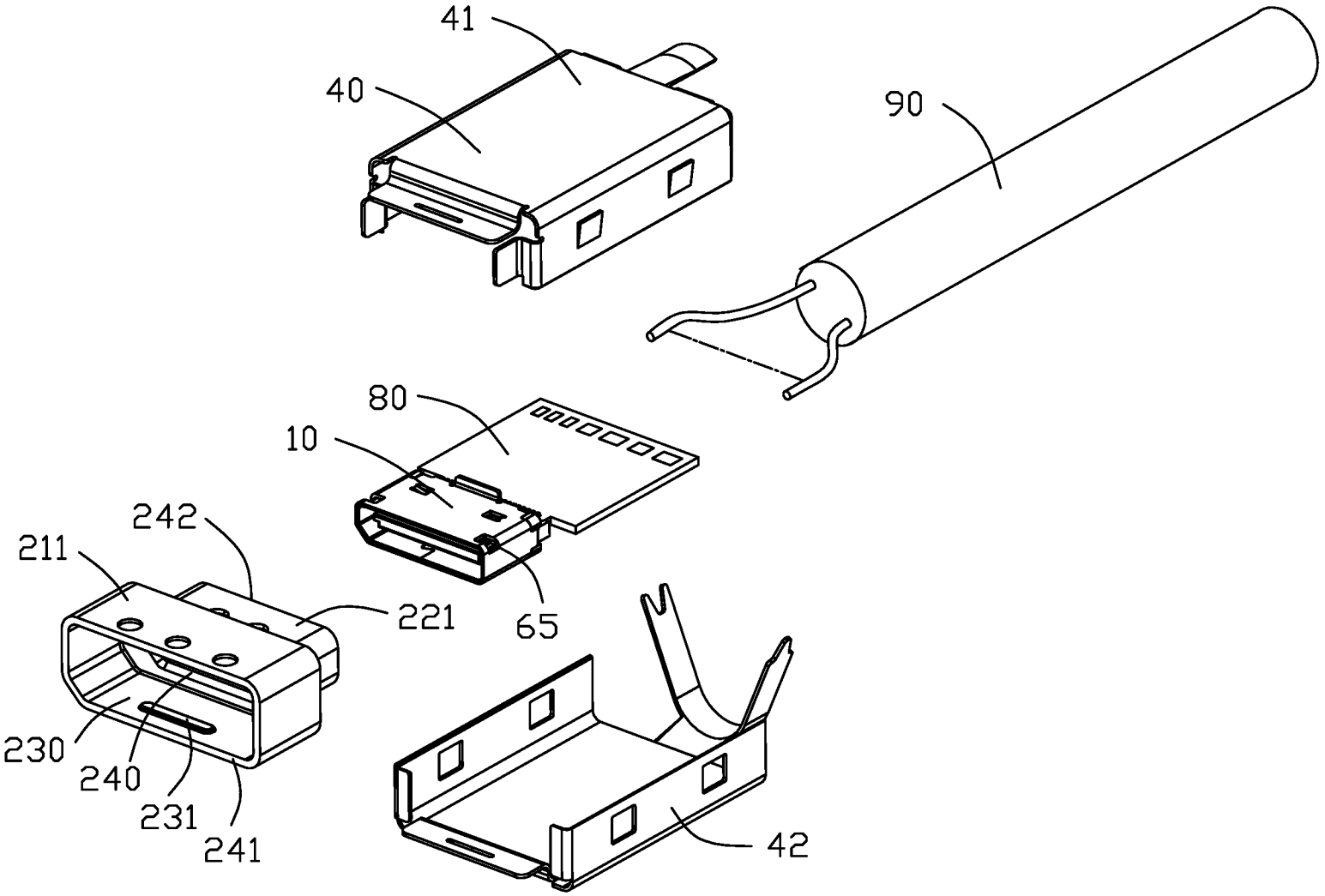
FIG. 4 is a further exploded view of the electrical connector in FIG. 2.
Figure 5:
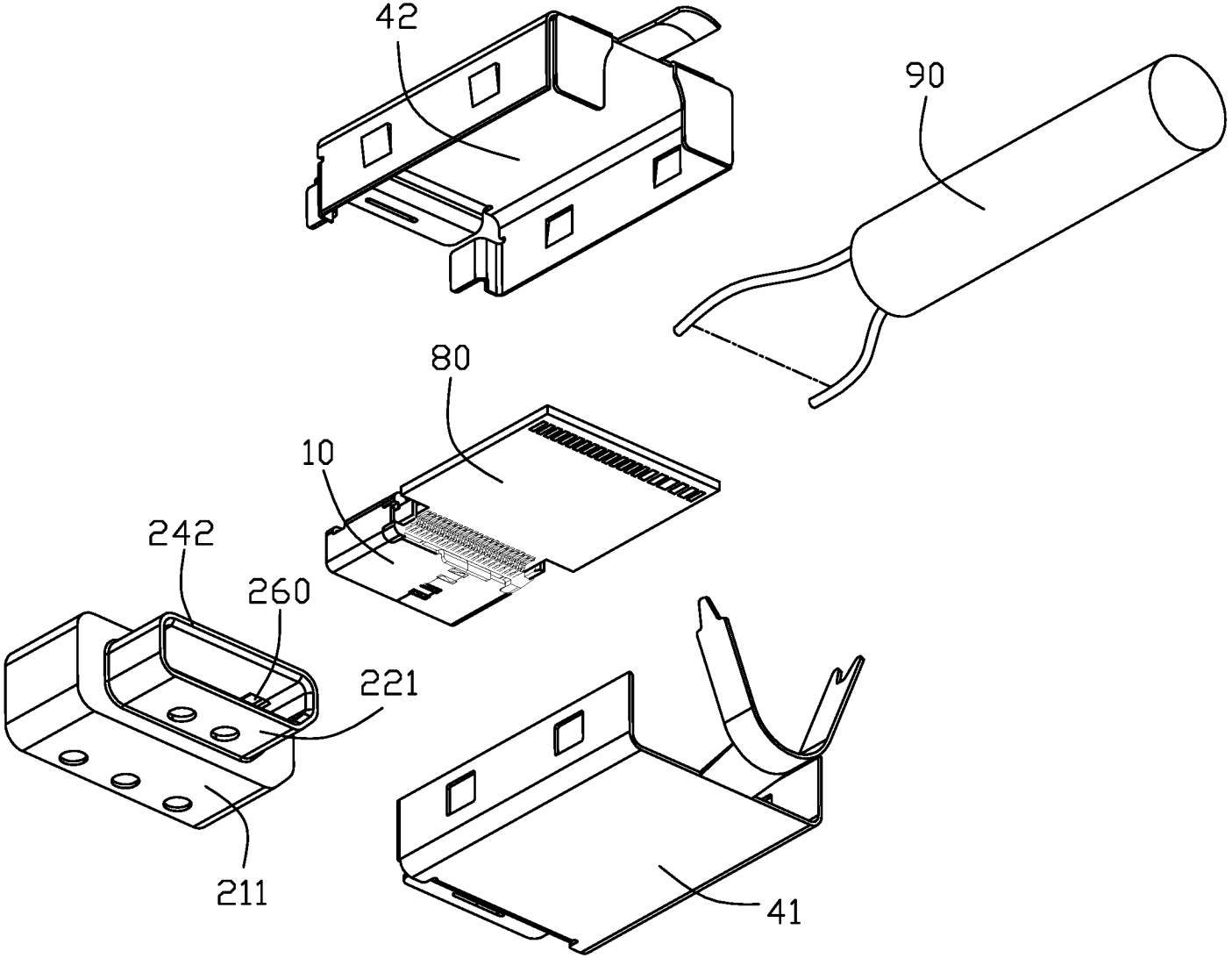
FIG. 5 is a view similar to FIG. 5 but from a different perspective.
Figure 6:
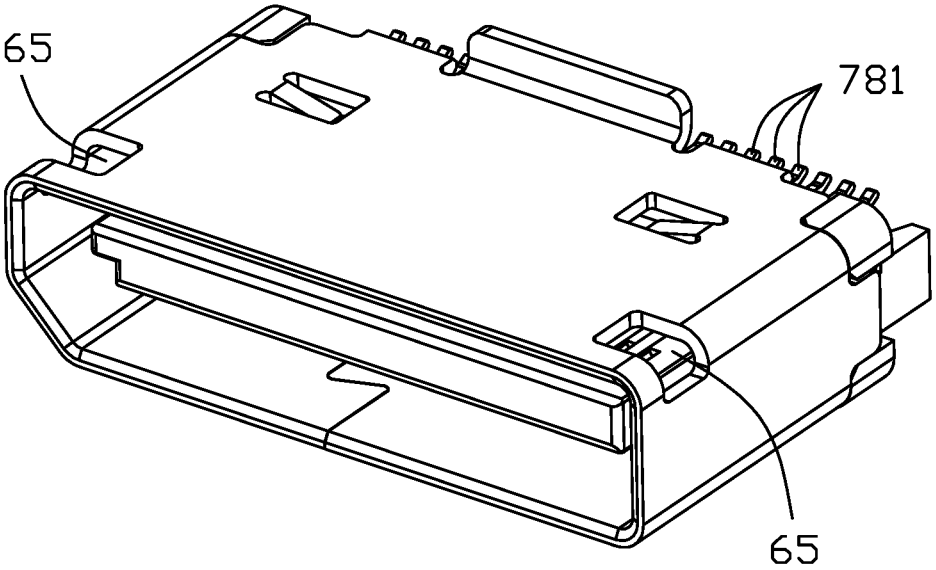
FIG. 6 is a perspective view of a mating part of the electrical connector.
Figure 7:
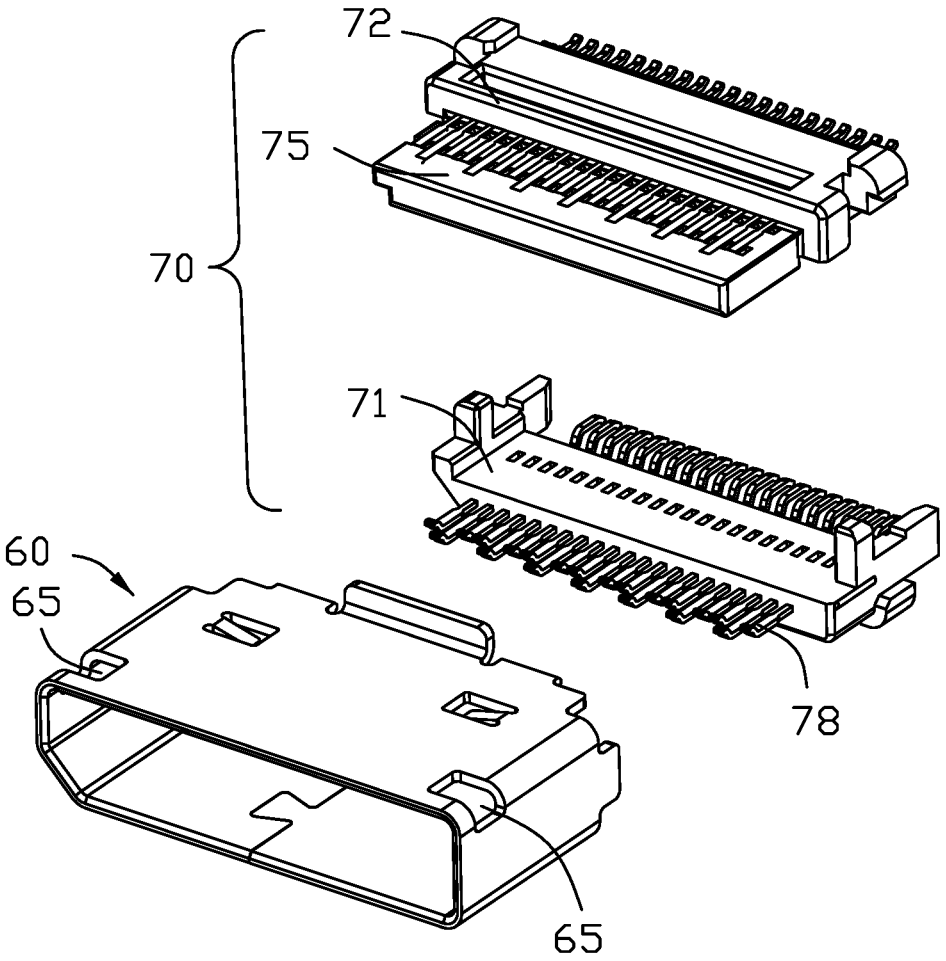
FIG. 7 is an exploded view of the mating part.
Figure 8:
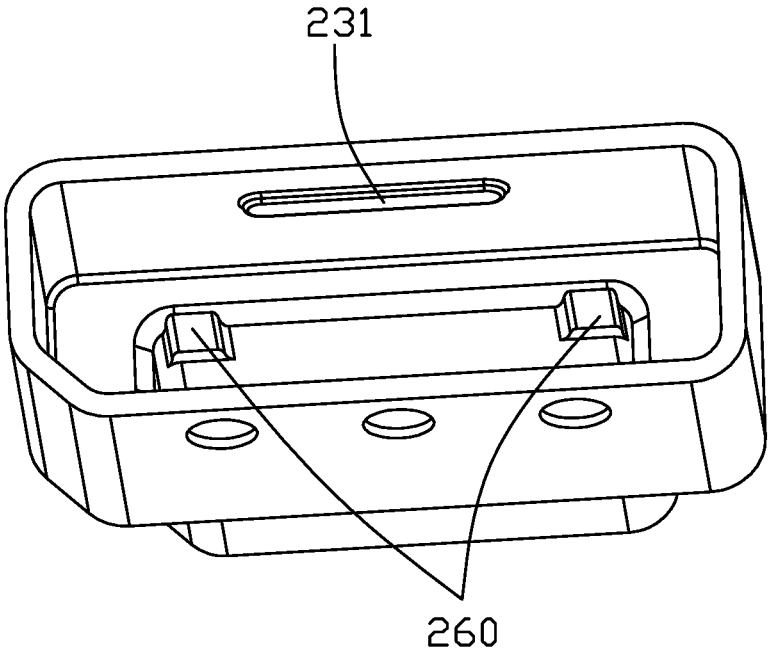
FIG. 8 is a perspective view of a sleeve of the electrical connector.
Figure 9:
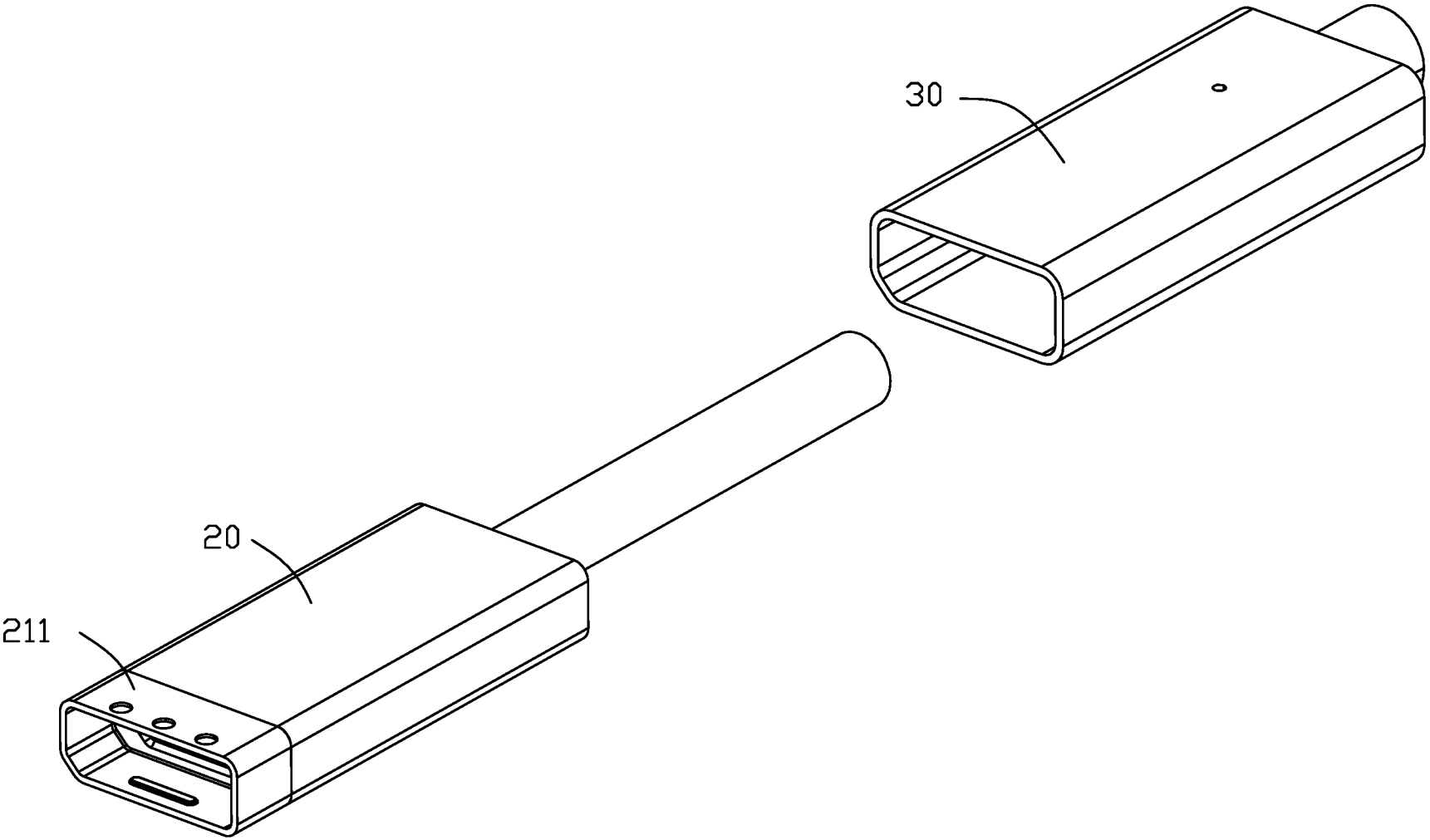
FIG. 9 is another exploded view of the electrical connector in FIG. 1.
Figure 10:
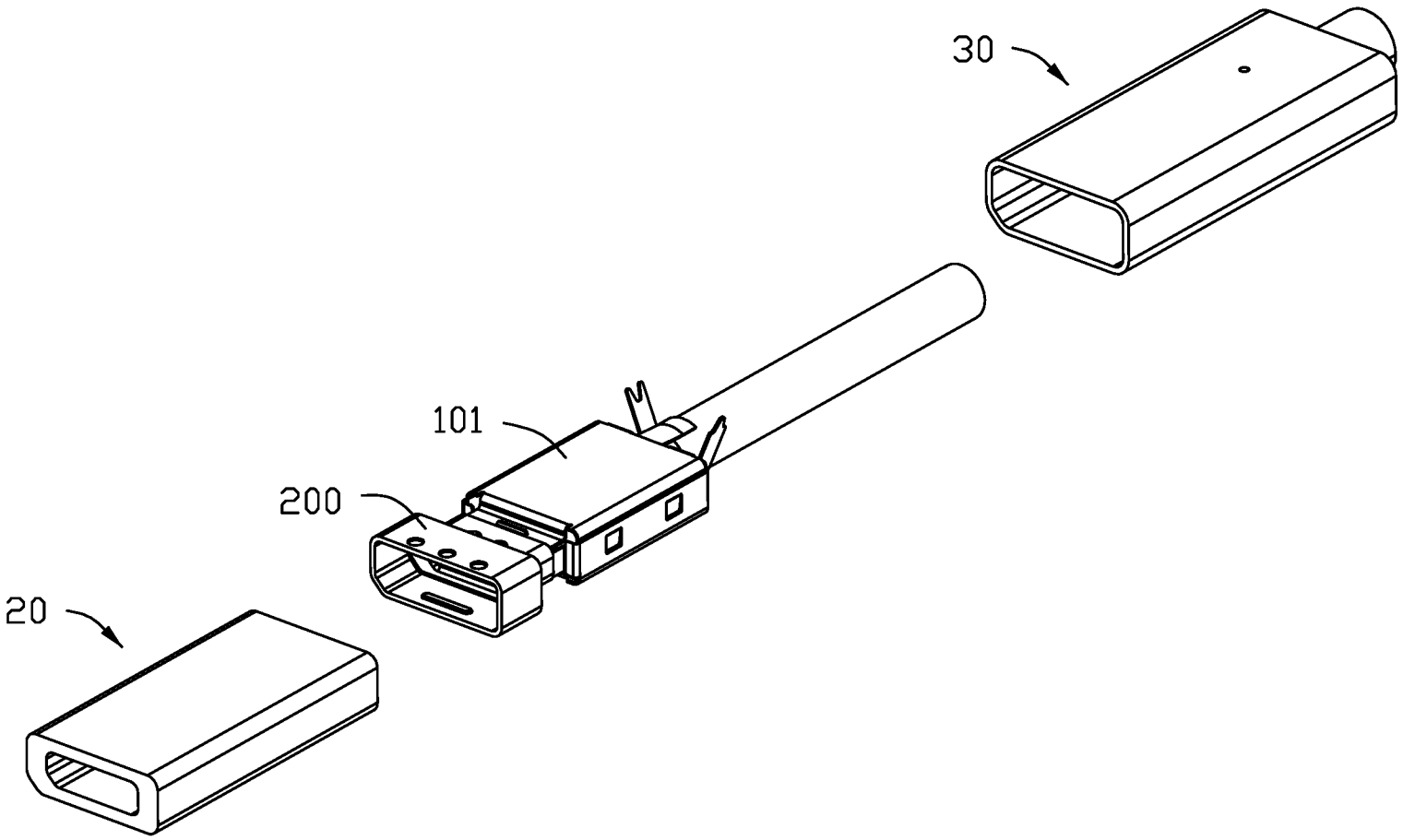
FIG. 10 is a further exploded view of the electrical connector in FIG. 9.
Figure 11:
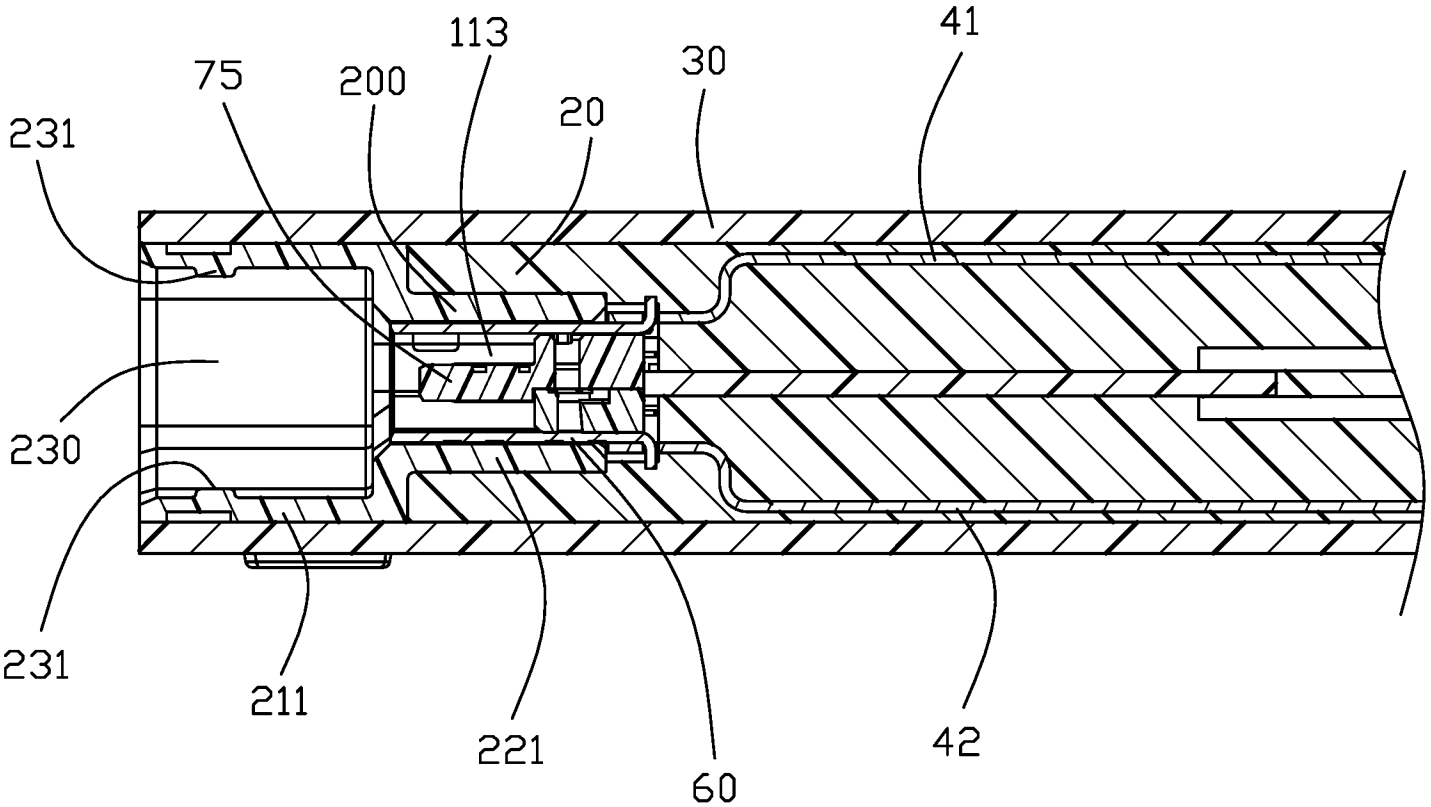
FIG. 11 is a cross-sectional view of the electrical connector taken along line A-A in FIG. 1.
Figure 12:
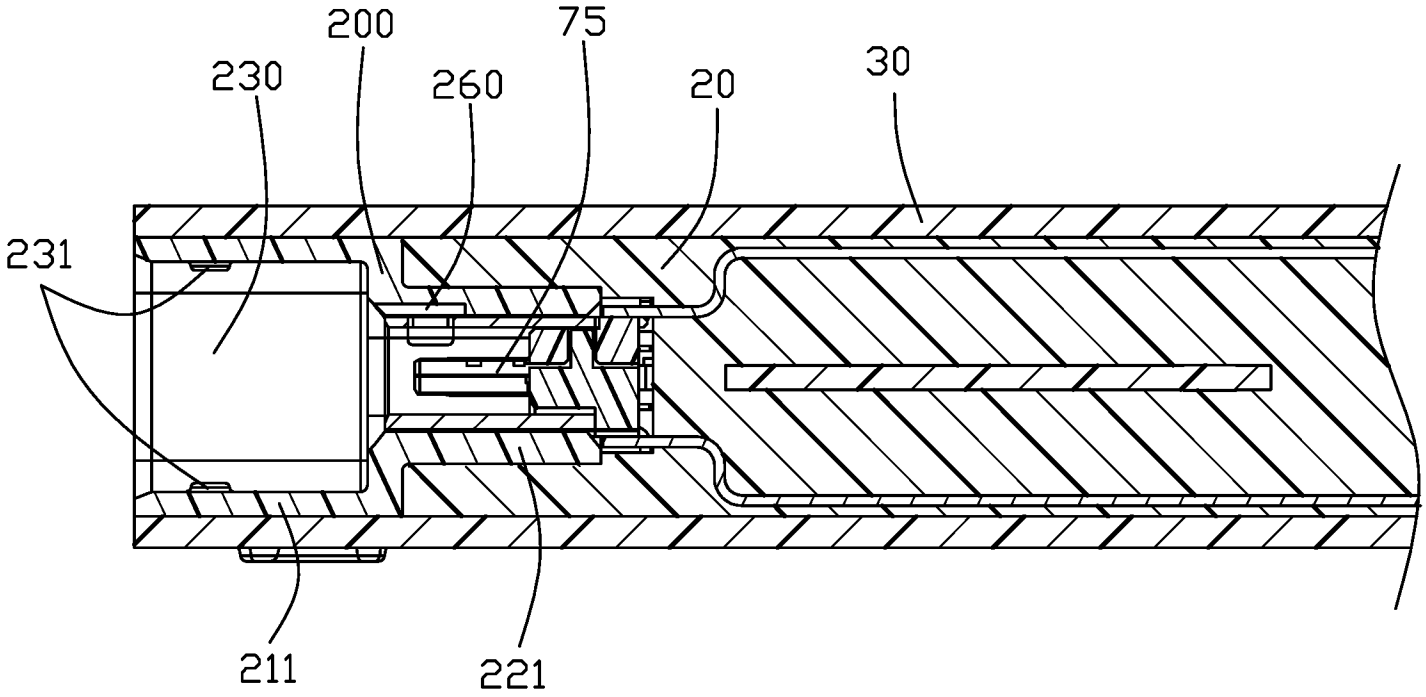
FIG. 12 is a cross-sectional view of the electrical connector taken along line B-B in FIG. 1.

Referring to FIGS. 1-12, an electrical connector 100 of a first embodiment comprises a connector unit 101, a sleeve 200, and an outer cover 30. The electrical connector 100 may further comprise an inner mold/cover 20 to adapt to various designs of the sleeve 200.

The connector unit 101 includes a metallic shell 60, a contact module 70 received in the shell 60, a printed circuit board (PCB) 80 connected to plural conductive contacts 78 of the module 70, and a cable 90 connected to a rear of the PCB 80. The contact module 70 has a first part 71 and a second part 72. One of the first part 71 and the second part 72 has a tongue 75. Each contact 78 has a tail 781 for soldering to the PCB 80. A mating part 10 is defined at a front of the connector unit 101 where the shell 60 encloses the tongue 75 of the contact module 70. An annular mating space 113 is defined between the tongue 75 and the shell 60. The mating part 10 has a front mating end 11. The shell 60 has a pair of openings 65 near the end 11. The connector unit 101 may further include an outer shell 40 attached to a rear of the shell 60 and enclosing the PCB 80 and a front of the cable 90. The outer shell 40 includes an upper body 41 and a lower body 42.

The sleeve 200 is formed separately and then mounted to the mating part 10 of the electrical connector 100. The sleeve 200 has a front portion 211 and a rear portion 221 that is mounted in a sealing manner to the shell 60. A cross-sectional interior dimension of the rear portion 221 of the sleeve 200 is less than a cross-sectional interior dimension of the front portion 211 of the sleeve 200. The front portion 211 has an end face 210. The sleeve 200 has a front end face 241, a rear end face 242, and a receiving space through the front and rear end faces. The front portion 211 and the rear portion 221 each have one or more recesses 215. The front portion 211 extends forwardly beyond the front mating end 11 of the mating part 10 to define a receiving chamber 230. The front portion 211 of the sleeve 200 has one or more reinforcing ribs 231 in the receiving chamber 230. The rear portion 221 has a pair of indentations 260 at positions corresponding to the pair of openings 65 of the shell 60. Provision of the sleeve 200 at the mating part 10 strengthens overall structure.

The inner mold 20 is molded over the rear portion 221 of the sleeve 200. The inner mold 20 spans from the end face 210 of the front portion 211 and has an exterior dimension substantially equal to that of the front portion 211 of the sleeve 200. The recesses 215 on the rear portion 221 help bonding of the inner mold 20 due to protrusions (not shown) formed on the inner mold 20 and received within the corresponding recesses 215. The rear portion 221 also helps sealing the openings 65 during molding the inner mold 20.

The outer cover 30 is molded over the front portion 211 of the sleeve 200 and the inner mold 20. The outer cover 30 is made of a material softer than the sleeve 200. Therefore, the design of the outer cover 30 becomes versatile in terms of color, material, and finish.

Figure 13:
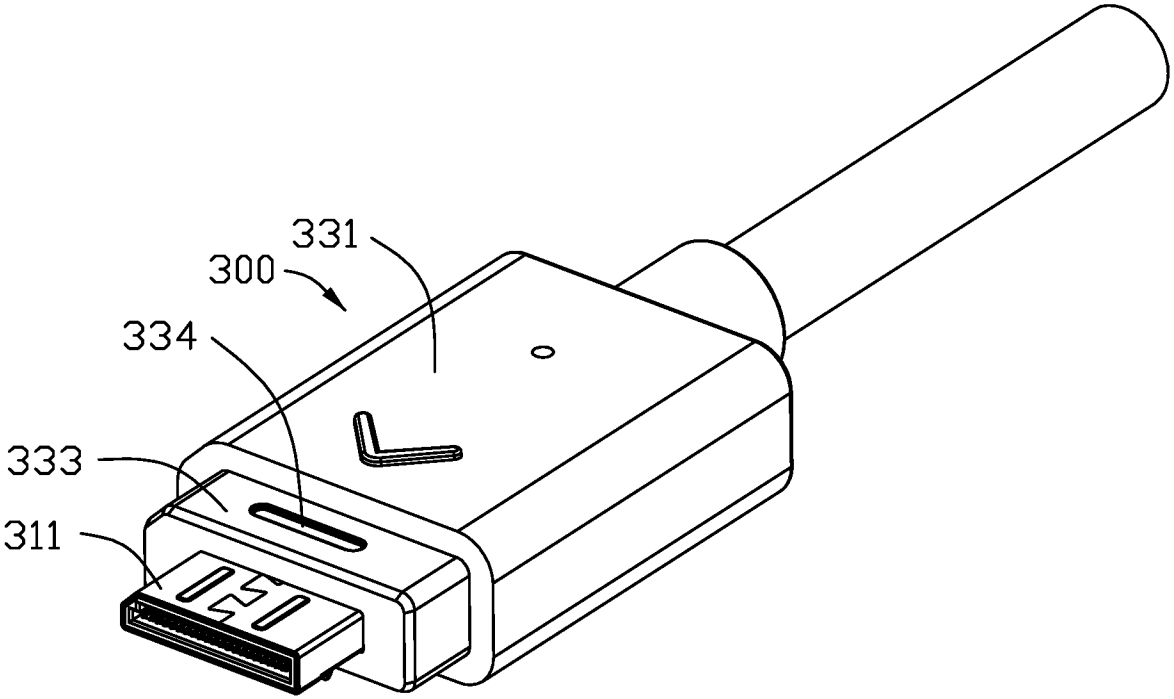
FIG. 13 is a perspective view of a mating connector in accordance with the present invention.
Figure 14:
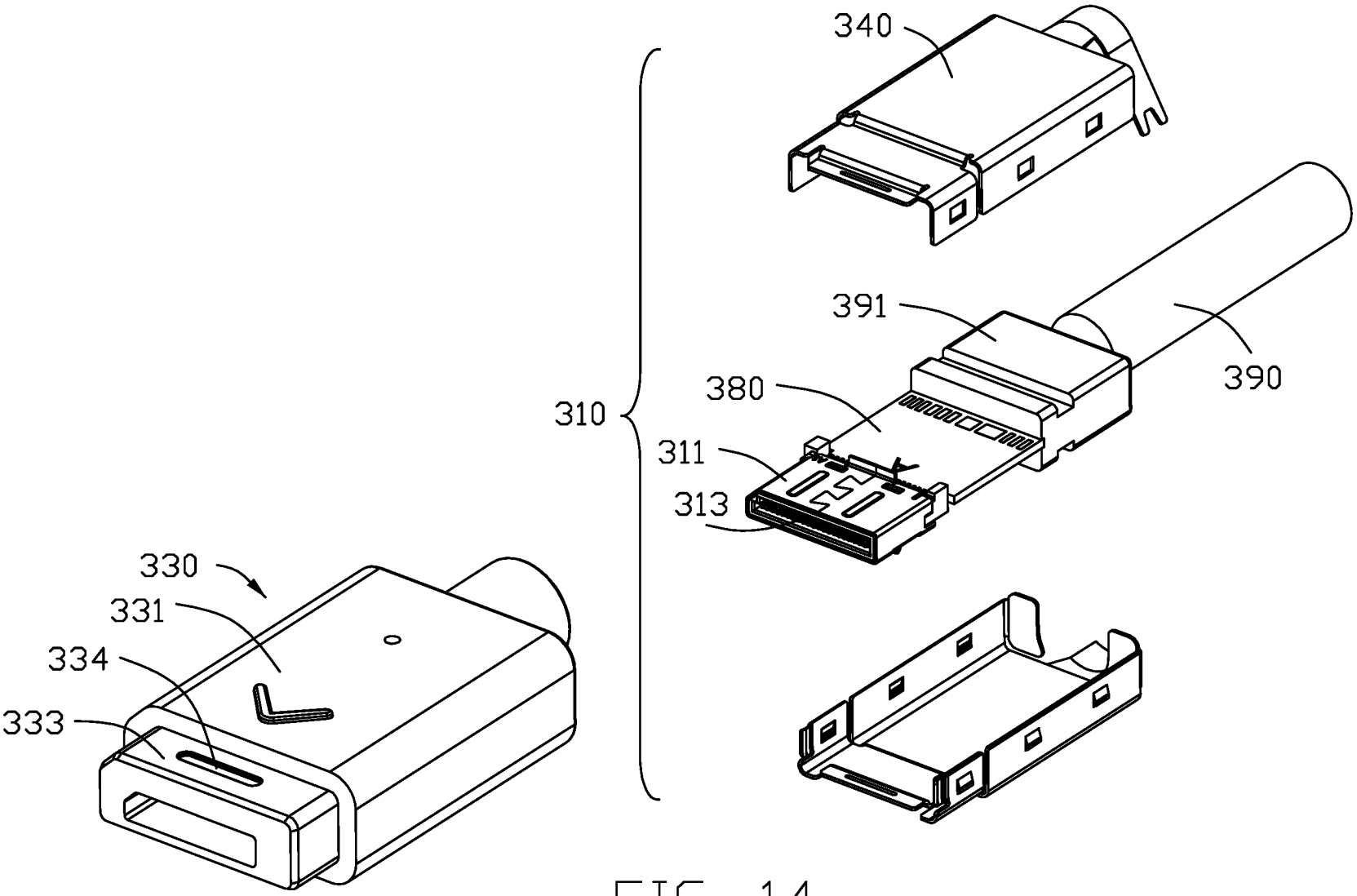
FIG. 14 is an exploded view of the mating connector.
Figure 15:
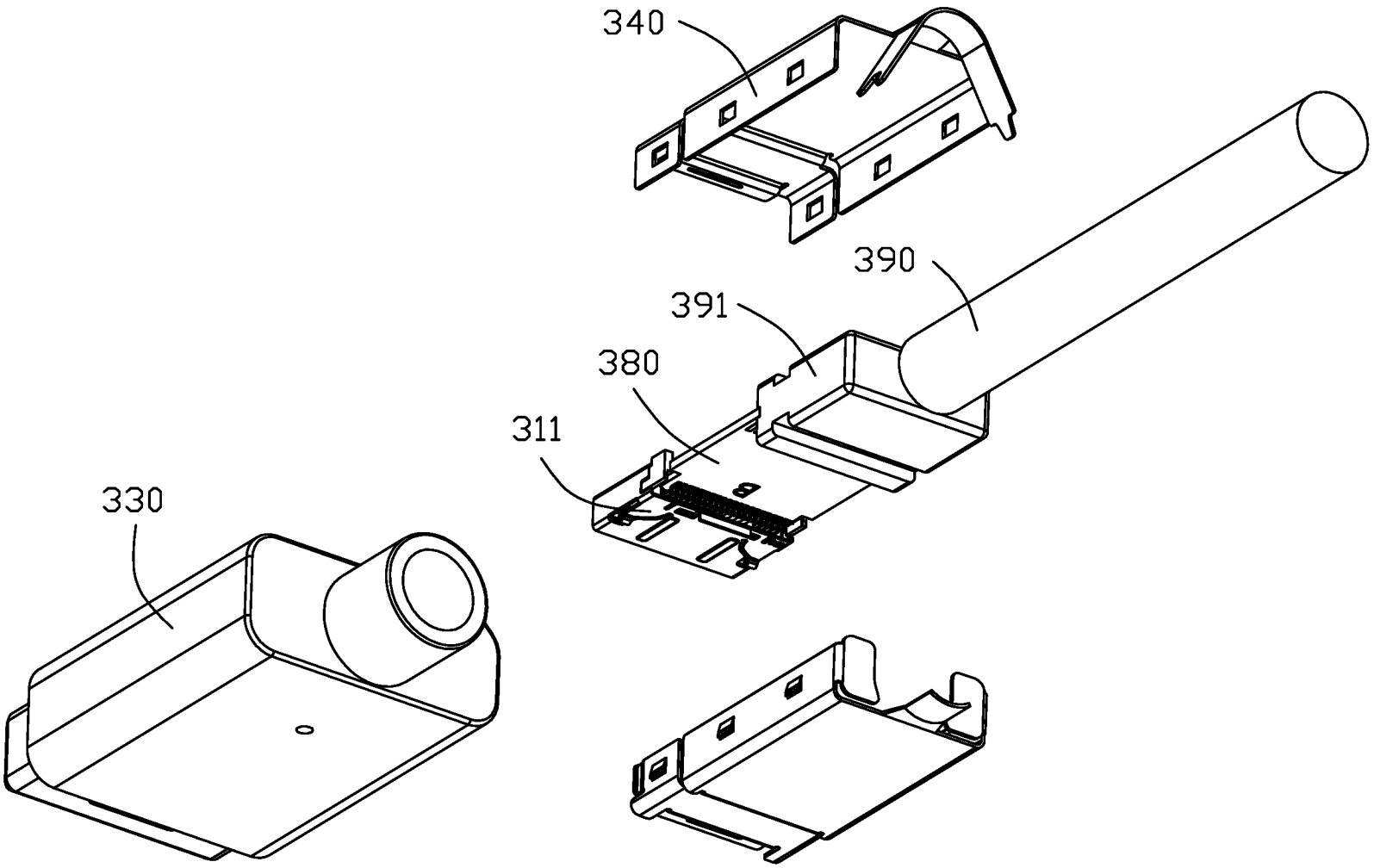
FIG. 15 is a view similar to FIG. 14 but from a different perspective.
Figure 16:
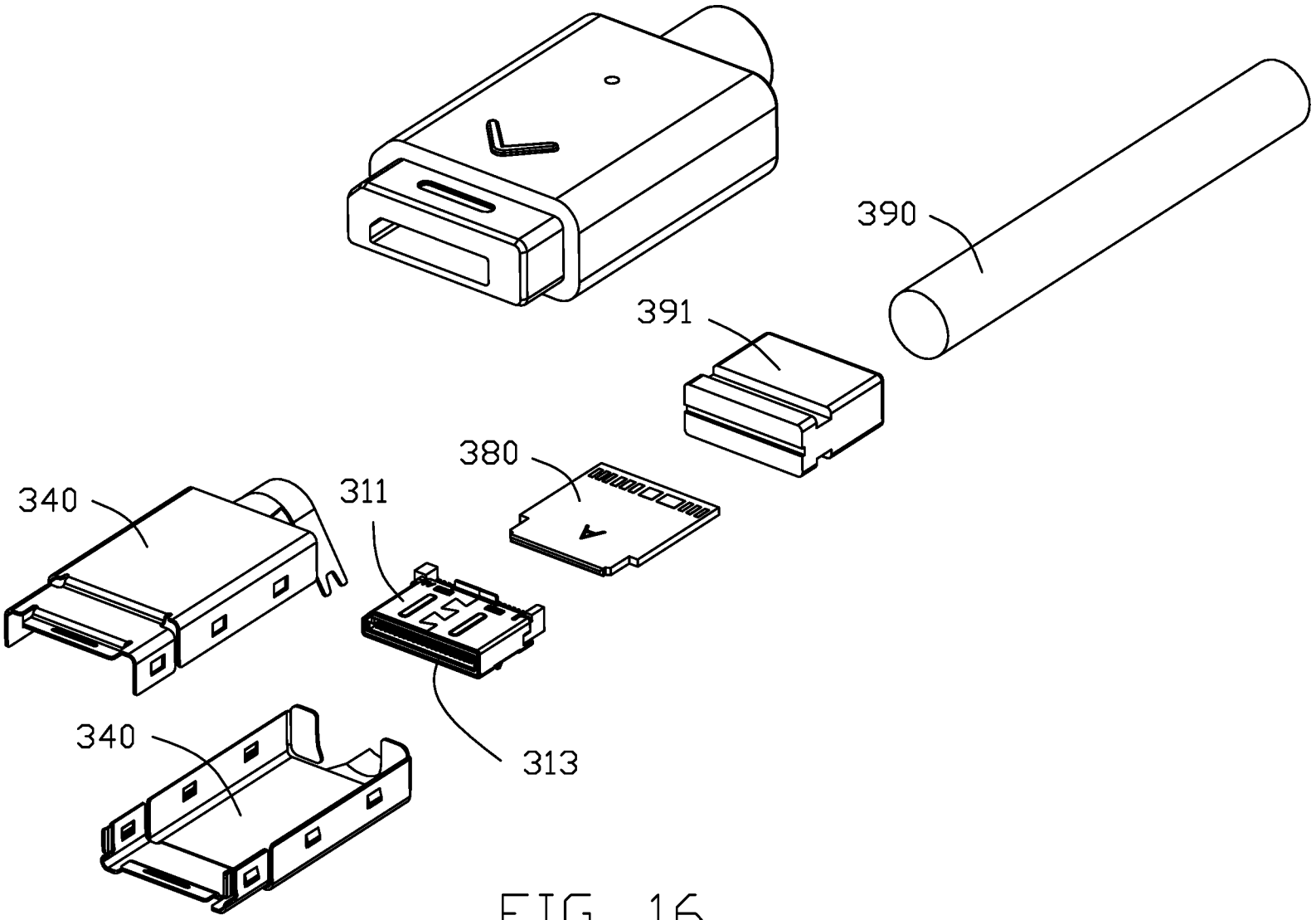
FIG. 16 is a further exploded view of the mating connector in FIG. 14.
Figure 17:
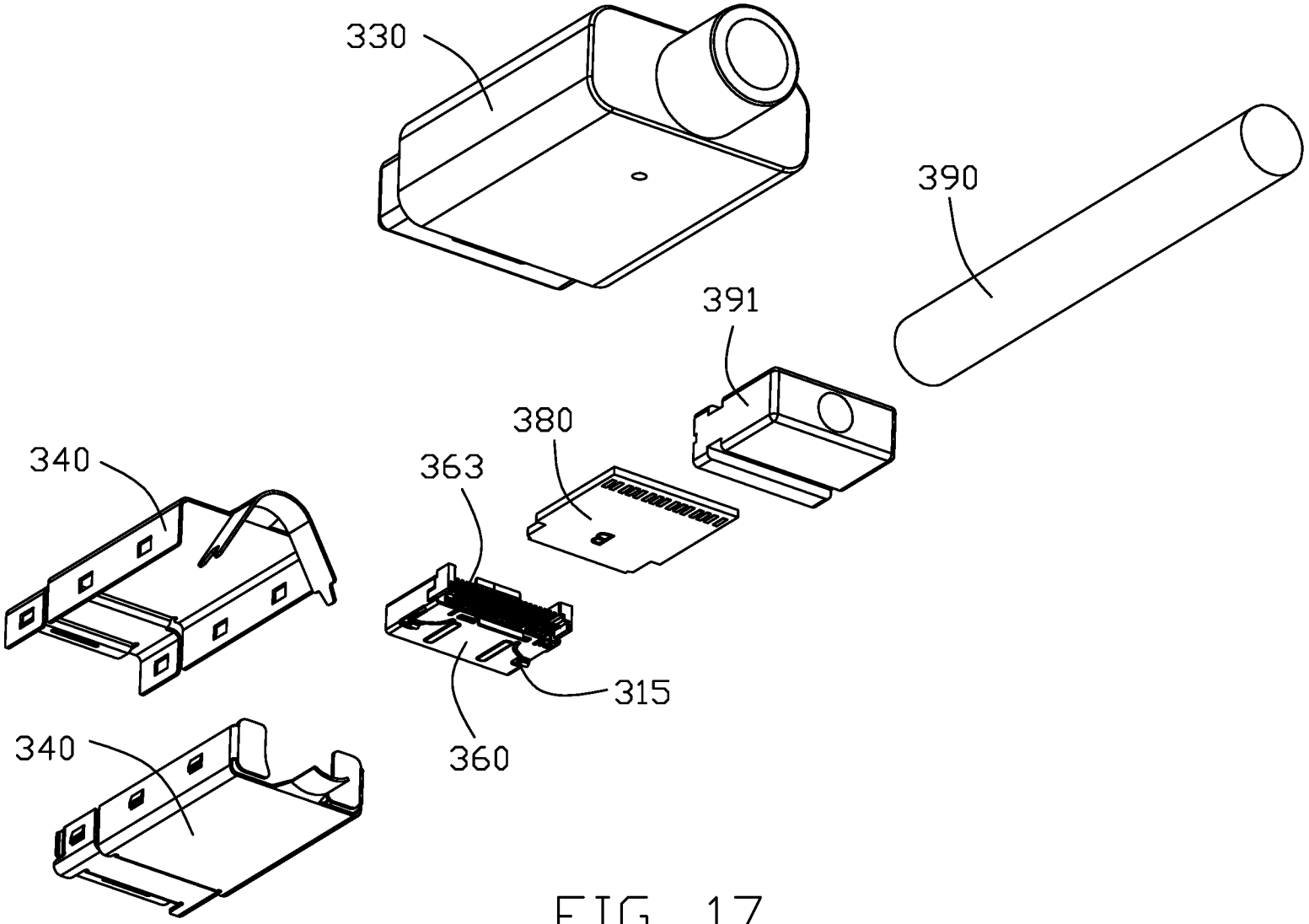
FIG. 17 is a further exploded view of the mating connector in FIG. 15.

Referring to FIGS. 13-17, a mating connector 300 comprises a connector unit 310 and an outer cover 330. The connector unit 310 includes a metallic shell 360, a contact module received in the shell 360, a printed circuit board (PCB) 380 connected to upper and lower rows of contacts 363 of the contact module, a cable 390 connected to a rear of the PCB 380, and a wire organizer 391. The connector unit 310 may further include an outer shell 340 attached to a rear of the shell 360 and enclosing the PCB 380 and a front of the cable 390. A mating part 311 is defined at a front of the connector unit 310 where the shell 360 encloses the contact module. A mating space 313 is defined in the shell 360 between the upper row of contacts and the lower row of contacts for receiving the tongue 75 of the electrical connector 100. The shell 360 has a pair of latches 315 for cooperating with the pair of openings 65 of the electrical connector 100.

The outer cover 330 has a first part 331 and a second part 333 in front of the first part 331. An exterior dimension of the first part 331 is greater than an exterior dimension of the second part 333. The second part 333 has one or more recesses 334 for cooperating with the one or more ribs 231 in the receiving chamber 230 of the electrical connector 100. The outer cover 330 encloses the connector unit 310; the mating part 311 of the connector 300 extends forwardly beyond the second part 333 of the outer cover 330.

Figure 18:
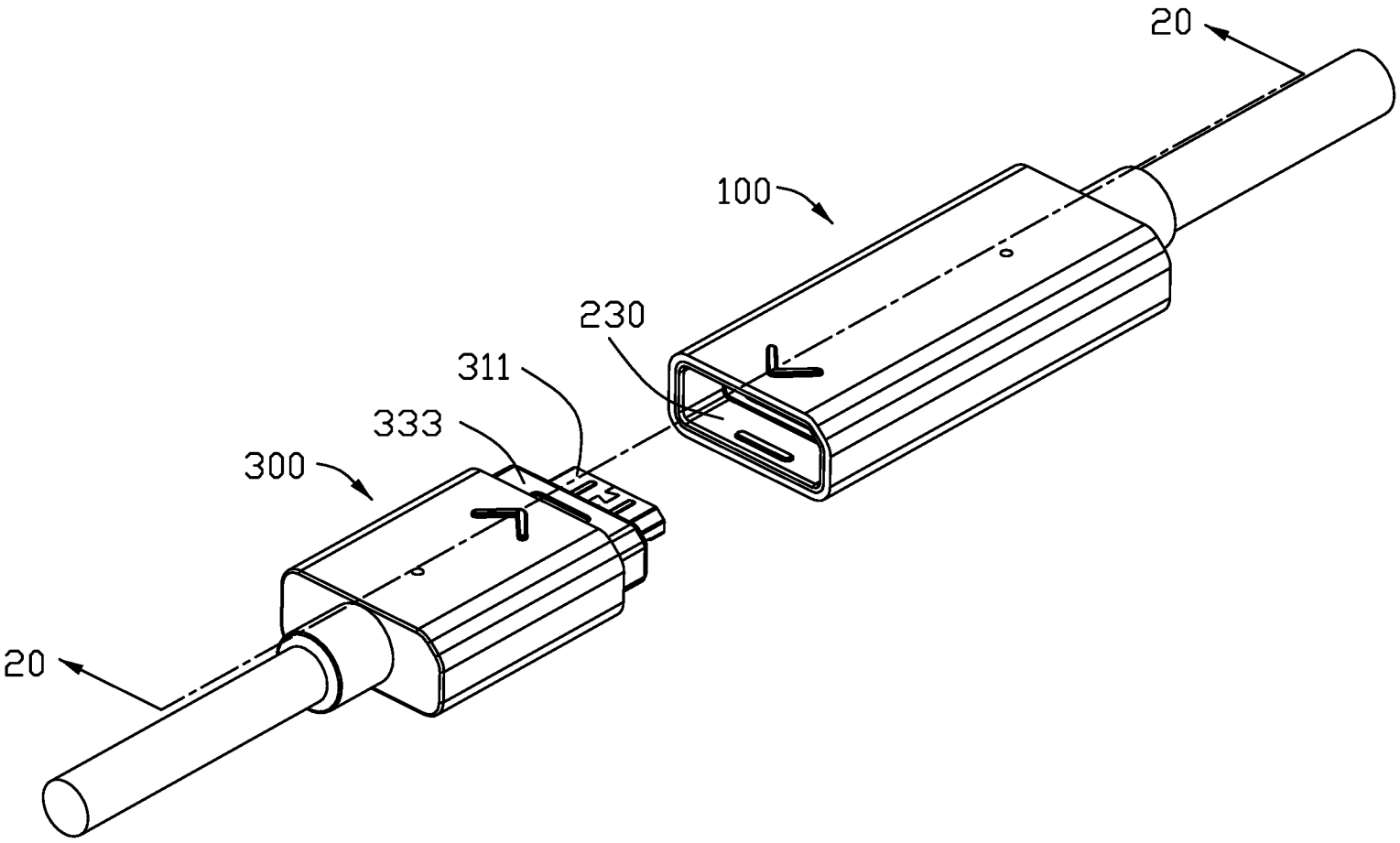
FIG. 18 is a perspective view of the electrical connector and the mating connector prior to mating.
Figure 19:
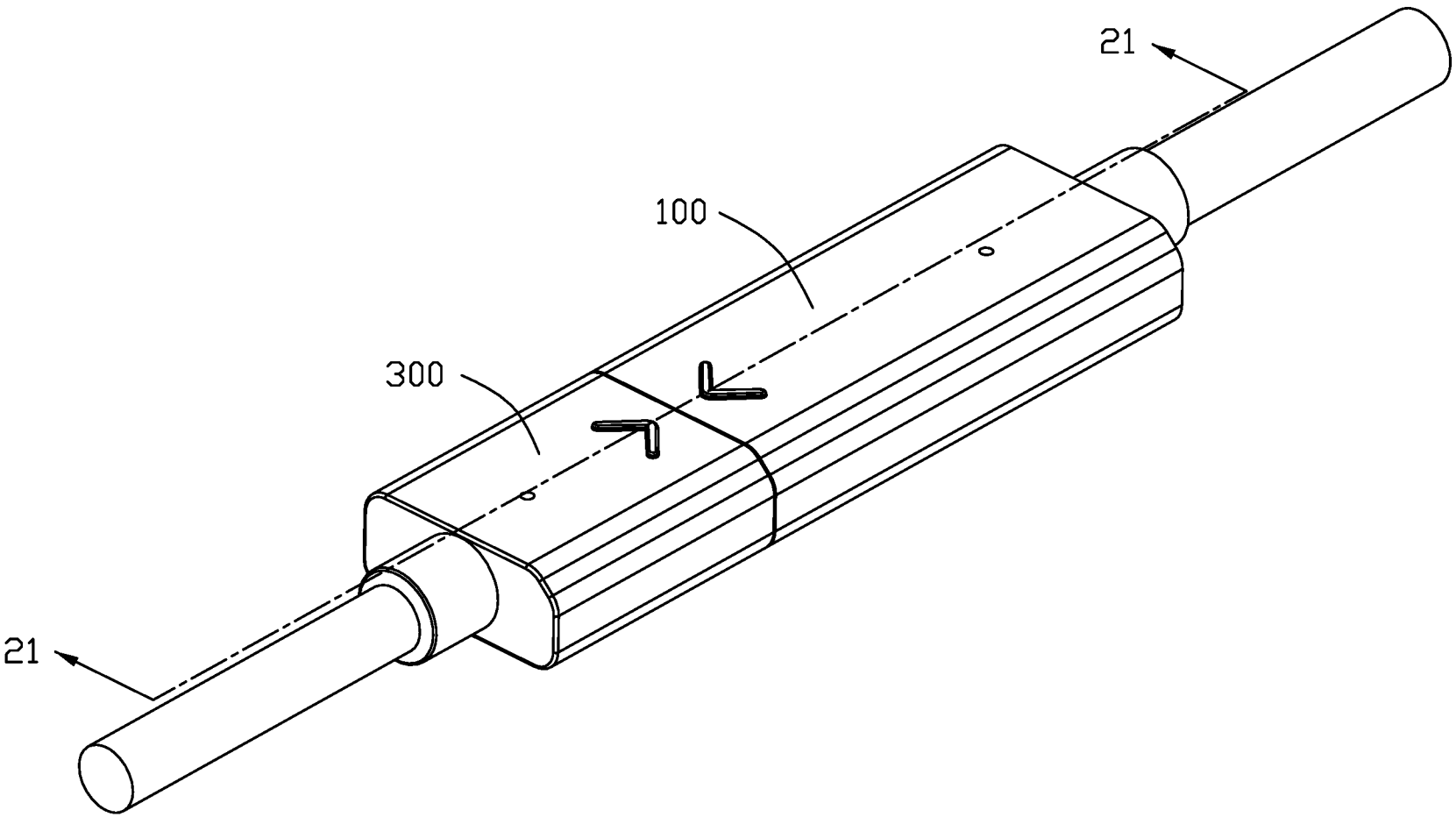
FIG. 19 is a perspective view of the electrical connector and the mating connector in mating.
Figure 20:
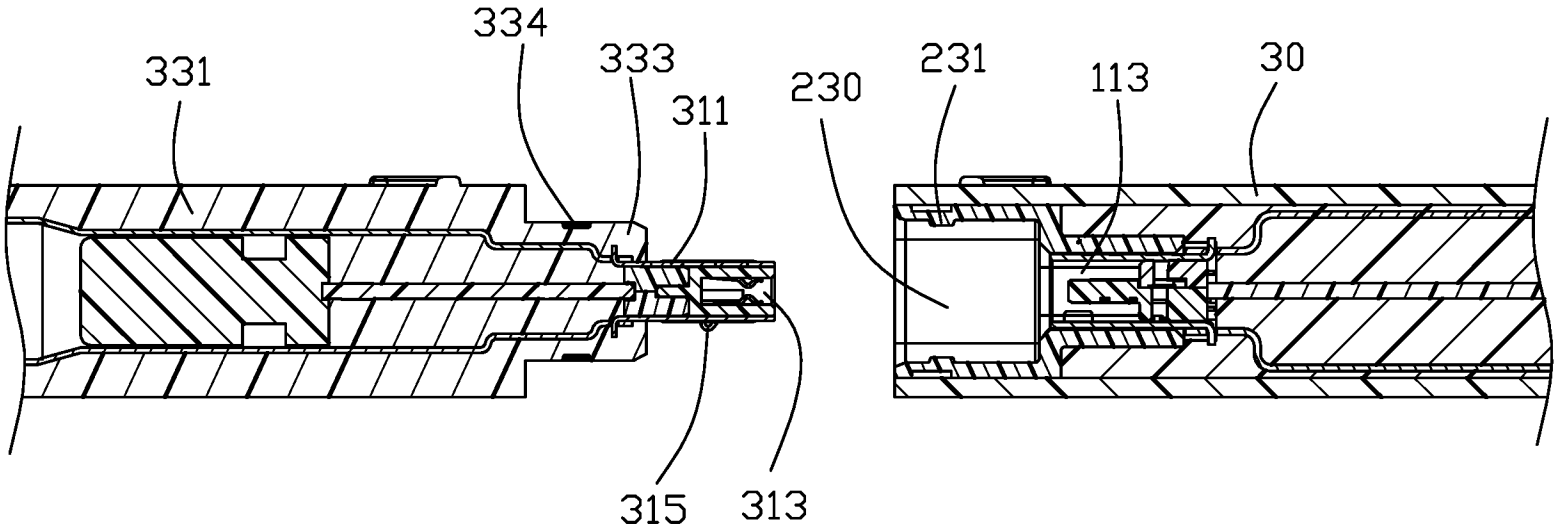
FIG. 20 is a cross-sectional view of the electrical connector and the mating connector taken along line C-C in FIG. 18.
Figure 21:
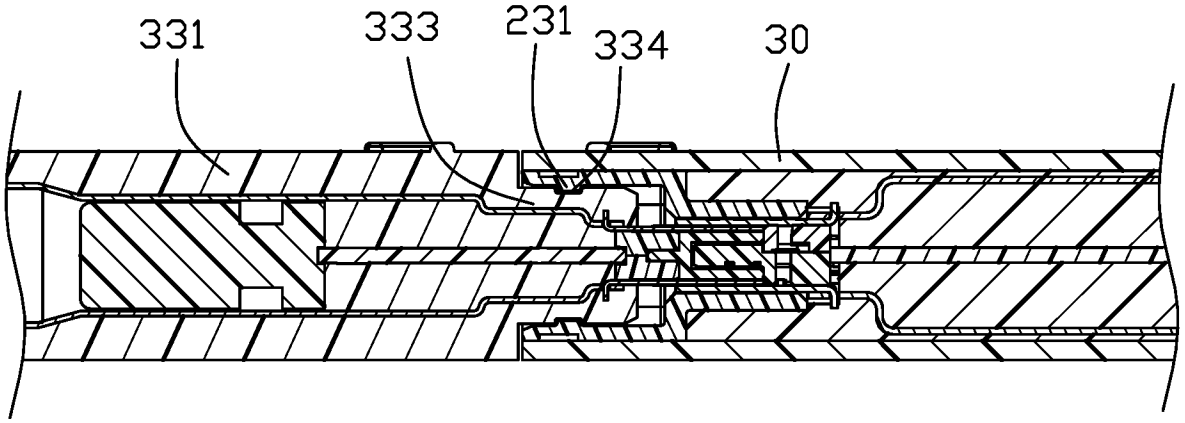
FIG. 21 is a cross-sectional view of the electrical connector and the mating connector taken along line C-C in FIG. 19.

Referring to FIGS. 18-21, a shape and dimension of the receiving chamber 230 of the electrical connector 100 generally matches or is greater than a shape and dimension of the second part 333 of the mating connector 300. A cross-sectional exterior dimension of the outer cover 30 of the electrical connector 100 is generally equal to a cross-sectional exterior dimension of the first part 331 of the mating connector 300.

Figure 22:
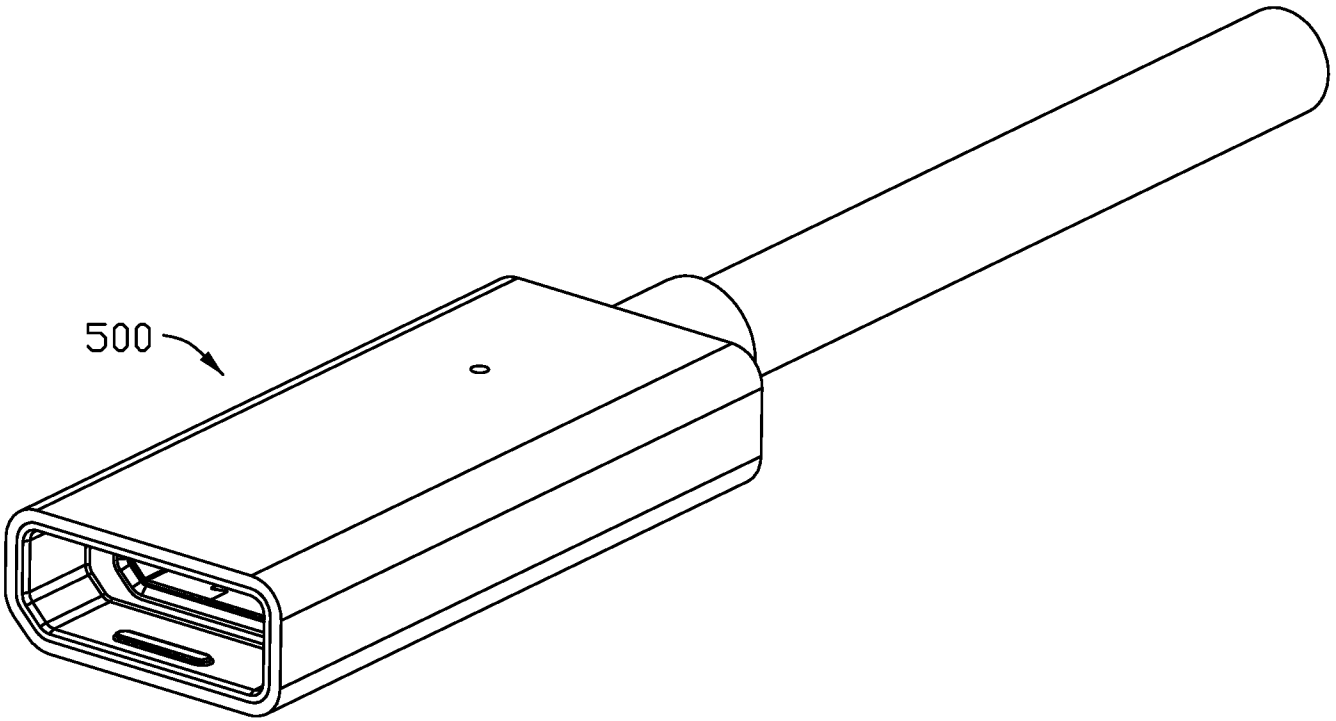
FIG. 22 is a perspective view of an electrical connector in accordance with a second embodiment of the present invention.
Figure 23:
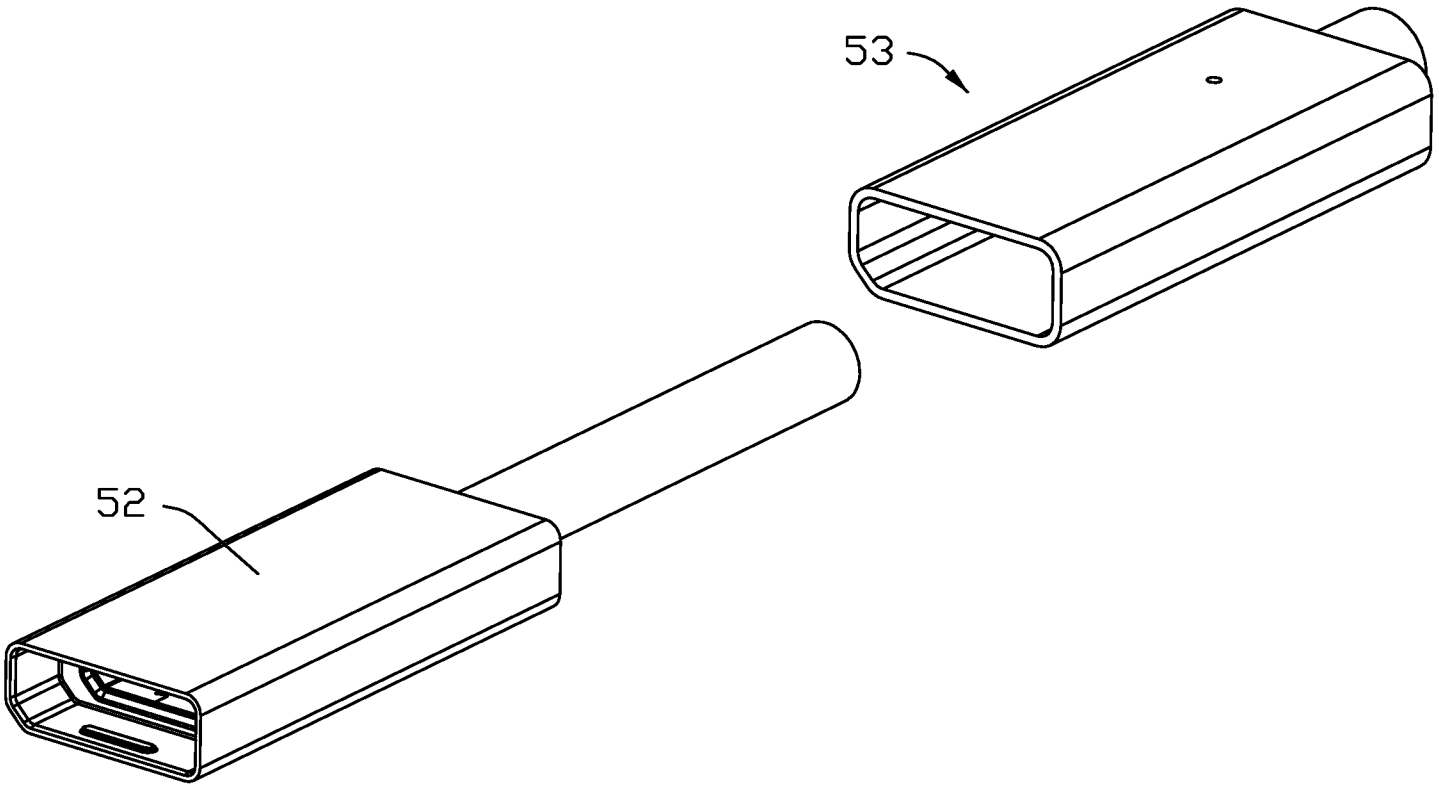
FIG. 23 is an exploded view of the electrical connector in FIG. 22.
Figure 24:
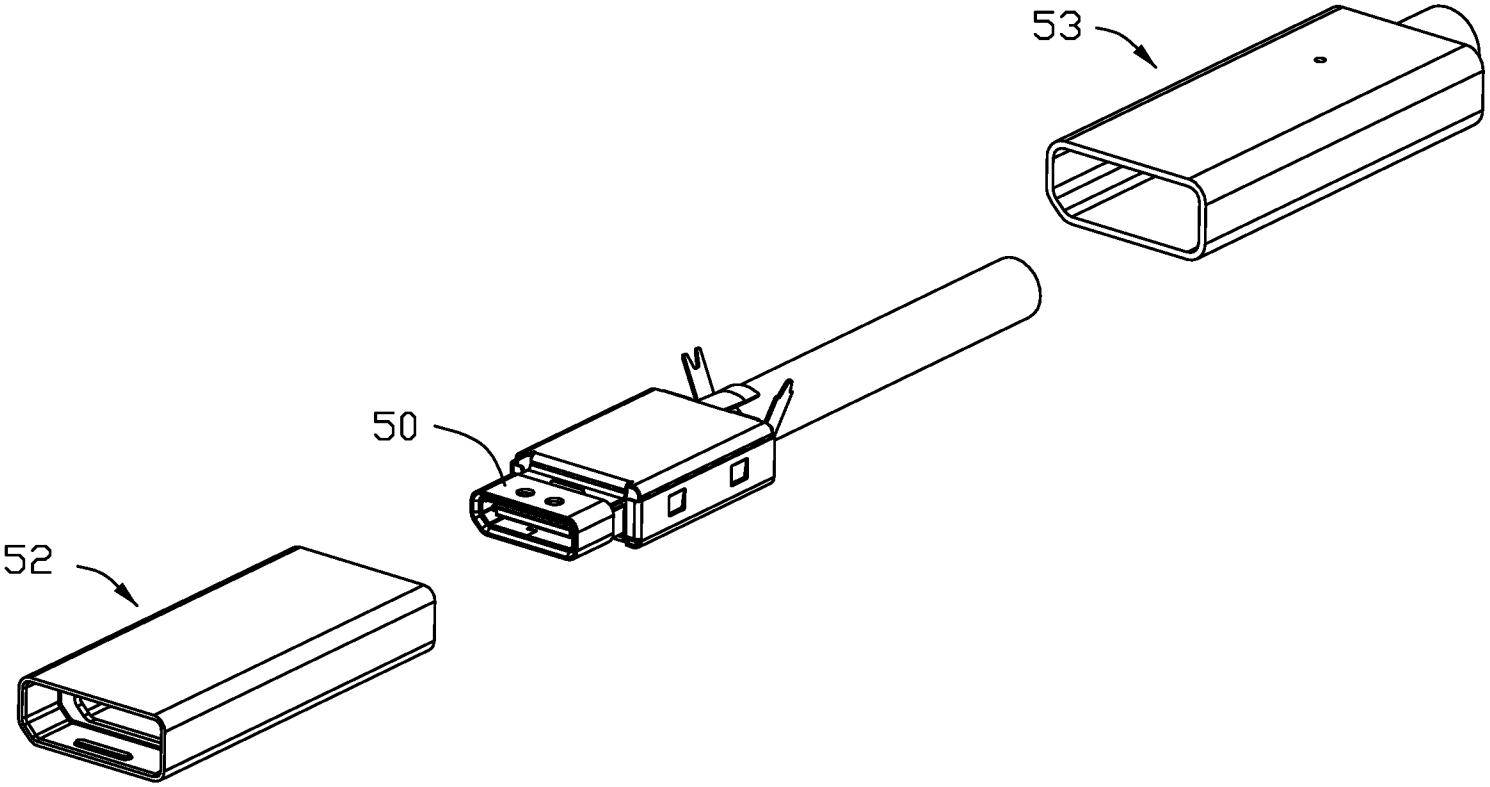
FIG. 24 is a further exploded view of the electrical connector in FIG. 23.
Figure 25:
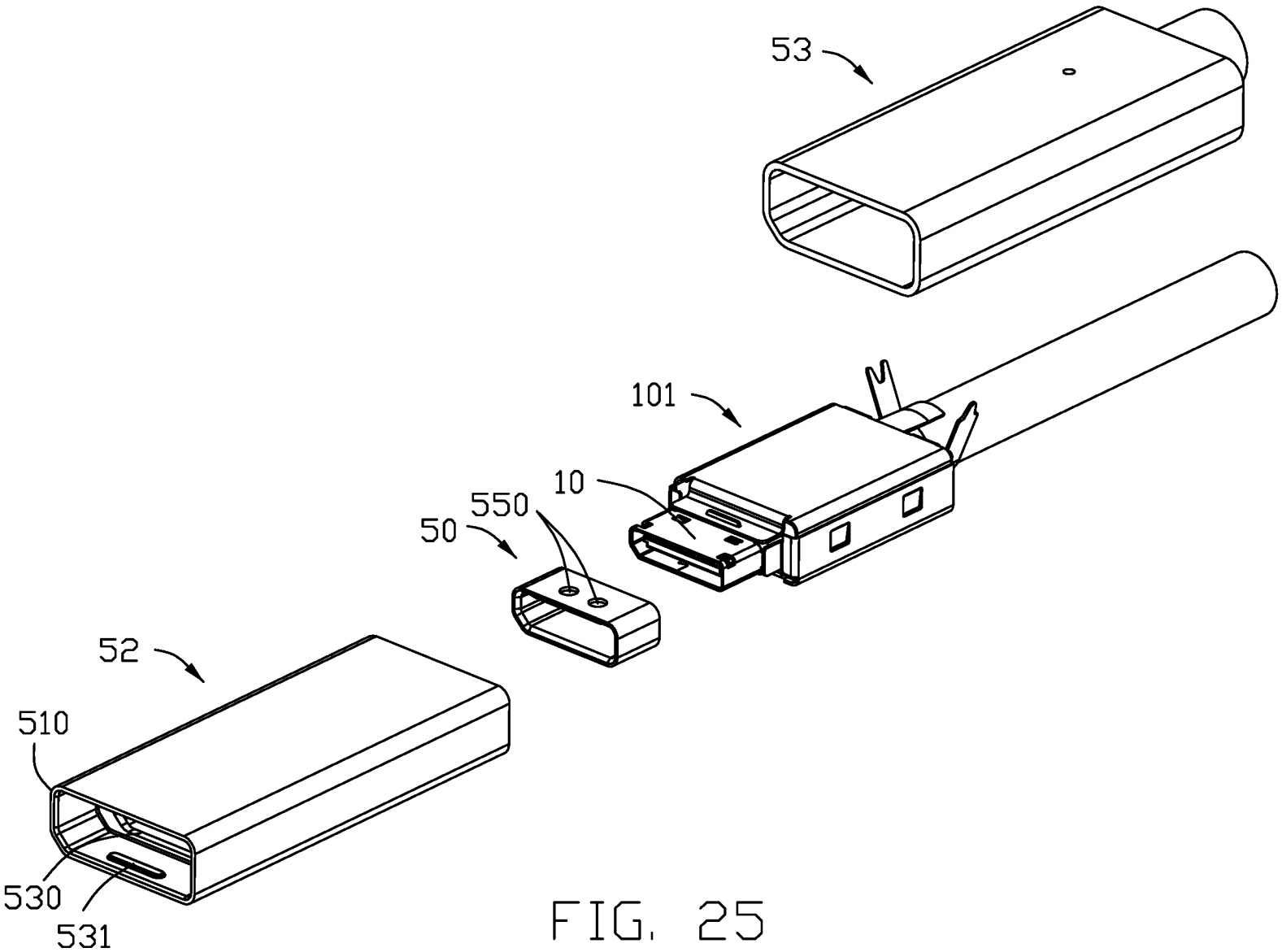
FIG. 25 is a still further exploded view of the electrical connector in FIG. 24.
Figure 26:
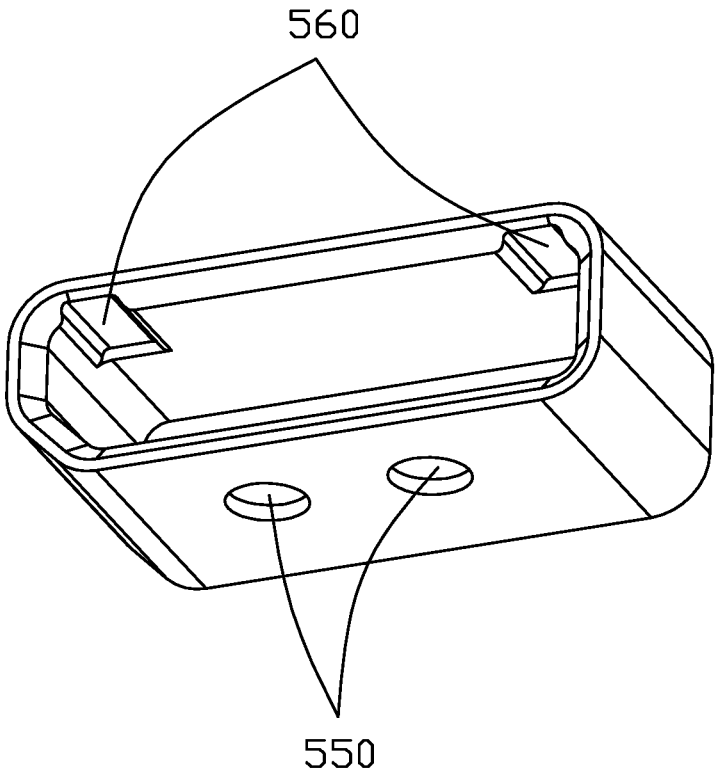
FIG. 26 is a perspective view of a divider of the electrical connector in FIG. 22.

Referring to FIGS. 22-26, an electrical connector 500 of a second embodiment comprises a connector unit 101 of generally same structure as in the first embodiment, a sleeve 52, and an outer cover 53 of generally same structure as the outer cover 30 in the first embodiment. The electrical connector 500 may further comprise a divider 50 for sealing the metallic shell 60 during molding the sleeve 52. In one non-limiting sense, the sleeve 52 in the second embodiment replaces the combination of the sleeve 200 and the inner mold 20 in the first embodiment. In another also non-limiting sense, the divider 50 in the second embodiment substitutes for the rear portion 221 of the sleeve 200 in the first embodiment.

The sleeve 52 is molded over the connector unit 101, and the divider 50 if present, and extends forwardly beyond the front mating end 11 of the mating part 10 to define a receiving chamber 530. The sleeve 52 has one or more reinforcing ribs 531 in the receiving chamber 530 for cooperating with the one or more recesses 334 of the mating connector 300. A shape and dimension of the receiving chamber 530 of the electrical connector 500 generally matches or is greater than a shape and dimension of the second part 333 of the mating connector 300. Provision of the sleeve 52 at the mating part 10 strengthens overall structure.

The divider 50 is formed separately and then mounted to the mating part 10 of the electrical connector 100. Therefore, the divider 50 seals the metallic shell 60 of the mating part 10 and then the sleeve 52 is integrally molded over the divider 50 and the connector unit 10. The divider 50 has one or more recesses 550 to help bonding of the sleeve 52 to the divider 50. The divider 50 has a pair of indentations 560 at positions corresponding to the pair of openings 65 of the shell 60 for accommodating the pair of latches 315 on the mating part 311 of the mating connector 300.

The outer cover 53 is molded over the sleeve 52. The outer cover 53 is made of a material softer than the sleeve 52. Therefore, the design of the outer cover 53 is versatile in terms of color, material, and finish.

Both the connector 100 of the first embodiment and the connector 500 of the second embodiment have respective reinforcing ribs 231 and 531 exposed to the receiving chambers 230 and 530 of the sleeves 200 and 52 for engaging the recesses 334 of the mating connector 300 in order to strengthen their mating connection. In both embodiments, the pair of latches 315 on the mating part 311 of the mating connector 300 are also provided for latching into the pair of openings 65 on the shell 60 of the mating part 10.

In brief, both the embodiments disclose an insulative rear tubular part, i.e., the rear portion 221 of the sleeve 200 or the divider 50, to enclose the mating part of the connector unit, and such an insulative rear tubular part is enclosed within an insulative cover over-molded thereon wherein another insulative front tubular part is located in front of the aforementioned insulative rear tubular part to form a receiving chamber which is aligned with the mating part of the connector unit in the front-to-back direction and is radially larger than the insulative rear tubular part, and such another insulative front tubular part is unitarily formed either with the insulative rear tubular part as disclosed in the first embodiment or with the inner cover as disclosed in the second embodiment.

What is claimed is:

1. An electrical connector comprising:

a connector unit having a mating part, the mating part defining a front mating end;

a sleeve enclosing the mating part and extending forwardly beyond the front mating end to define a receiving chamber; and an outer cover enclosing the sleeve and the connector unit; wherein the sleeve has a front portion containing the receiving chamber;

the outer cover is made of a material softer than the sleeve;

the mating part of the connector unit has a metallic shell, and the sleeve has a rear portion sealing the metallic shell; and the metallic shell has a pair of latching openings.

2. The electrical connector as claimed in claim 1, further comprising a divider, and wherein the mating part of the connector unit has a metallic shell sealed by the divider, and the sleeve is integrally molded over the divider and the connector unit.

3. The electrical connector as claimed in claim 2, wherein the front portion of the sleeve has a reinforcing rib in the receiving chamber.

4. An electrical connector comprising:

a connector unit having a mating part, the mating part defining a front mating end;

a sleeve enclosing the mating part and extending forwardly beyond the front mating end to define a receiving chamber; and an outer cover enclosing the sleeve and the connector unit; wherein the sleeve has a front portion containing the receiving chamber; and the outer cover is made of a material softer than the sleevez the mating part of the connector unit has a metallic shell, and the sleeve has a rear portion sealing the metallic shell; and a cross-sectional interior dimension of the rear portion of the sleeve is less than a cross-sectional interior dimension of the front portion of the sleeve.

5. The electrical connector as claimed in claim 4, further comprising an inner mold molded over the rear portion of the sleeve and having an exterior dimension substantially equal to that of the front portion of the sleeve.

6. The electrical connector as claimed in claim 4, wherein the metallic shell has a pair of latching openings.

7. The electrical connector as claimed in claim 4, further comprising a divider, and wherein the mating part of the connector unit has a metallic shell sealed by the divider, and the sleeve is integrally molded over the divider and the connector unit.

8. The electrical connector as claimed in claim 4, wherein the front portion of the sleeve has a reinforcing rib in the receiving chamber.

9. The electrical connector as claimed in claim 4, wherein a front end face of the sleeve and a front end face of the outer cover are substantially flush.

10. An electrical sable connector for mating with another cable a mating connector, comprising:

a connector unit having a mating part in a front section thereof, the mating part defining a front mating end;

an insulative sleeve enclosing the mating part and extending forwardly beyond the front mating end to define a receiving chamber; and an insulative outer cover enclosing the sleeve and the connector unit; wherein the sleeve has a front portion containing the receiving chamber; wherein the mating part includes a metallic shell enclosing a tongue of a contact module therein with an annular mating space therebetween radially; and the shell forms a pair of openings communicating with the mating space for engagement with a pair of latches of the mating connector.

11. The electrical connector as claimed in claim 10, wherein the sleeve forms at least one rib extending into the receiving chamber for engagement with an insulative outer cover of the mating connector.

12. The electrical connector as claimed in claim 10, wherein the sleeve forms a pair of indentations communicatively aligned with the corresponding pair of openings in a vertical direction for receiving the pair of latches of the mating connector.

13. The electrical connector as claimed in claim 10, further including an insulative inner mold enclosing a rear part of the sleeve while being coplanar with a front part of the sleeve.

14. The electrical connector as claimed in claim 13, wherein the outer cover enclosing both the sleeve and the inner mold.

15. An electrical connector for mating with another cable connector, comprising:

a connector unit having a mating part in a front section thereof, the mating part defining a front mating end and including a metallic shell enclosing a tongue of a contact module therein with an annular mating space therebetween radially, the shell forming a pair of openings communicating with the mating space in a vertical direction for receiving a pair of latches of the another cable connector;

an insulative rear tubular part enclosing the mating part to cover the pair of opening in the vertical direction;

an insulative front tubular part located in front of the insulative rear tubular part along a front-to-back direction perpendicular to the vertical direction, and radially larger than the insulative rear tubular part to form a receiving chamber therein; and an insulative cover over-molded upon the insulative rear tubular part circumferentially; wherein the insulative front tubular part is unitarily formed either with the insulative rear tubular part or with the insulative cover.

16. The electrical connector as claimed in claim 15, wherein the insulative rear tubular part forms a plurality recess in an exterior face facing to receive corresponding protrusions of the insulative cover.

17. The electrical connector as claimed in claim 15, wherein the insulative rear tubular part forms a pair of indentations communicatively aligned with the corresponding pair of openings for receiving the pair of latches of said another cable connector.

18. The electrical connector as claimed in claim 17, wherein the insulative front tubular part forms at least one rib inwardly extending toward the receiving chamber for engagement with said another cable connector.

19. The electrical connector as claimed in claim 15, further including another insulative outer cover to enclose both the insulative rear tubular part and the insulative front tubular part circumferentially when the insulative front tubular part is unitarily formed with the insulative rear tubular part.

20. The electrical connector as claimed in claim 19, wherein said insulative cover is essentially coplanar with the insulative front tubular part along the front-to-back direction.

* * * * *